US007889160B2

(12) United States Patent
Yoo

(10) Patent No.: US 7,889,160 B2
(45) Date of Patent: Feb. 15, 2011

(54) ORGANIC LIGHT-EMITTING DIODE DISPLAY DEVICE AND DRIVING METHOD THEREOF

(75) Inventor: Juhn Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1003 days.

(21) Appl. No.: 11/602,501

(22) Filed: Nov. 21, 2006

(65) Prior Publication Data

US 2008/0001857 A1 Jan. 3, 2008

(30) Foreign Application Priority Data

Jun. 30, 2006 (KR) ..... 10-2006-0060543

(51) Int. Cl.
*G09G 3/32* (2006.01)

(52) U.S. Cl. ..... 345/83; 345/80; 345/82; 345/84; 345/204; 345/205

(58) Field of Classification Search ..... 345/55, 345/76, 77, 80, 82, 83, 84, 87, 90, 91, 92, 345/93, 204, 205, 206
See application file for complete search history.

(56) References Cited

U.S. PATENT DOCUMENTS

2004/0145547 A1* 7/2004 Oh ..... 345/76
2006/0066532 A1* 3/2006 Jeong ..... 345/76
2006/0139253 A1* 6/2006 Choi et al. ..... 345/76
2006/0248420 A1* 11/2006 Jeong ..... 714/727
2007/0273618 A1* 11/2007 Hsieh et al. ..... 345/76

* cited by examiner

*Primary Examiner*—My-Chau T Tran
(74) *Attorney, Agent, or Firm*—Morgan, Lewis & Bockius LLP

(57) ABSTRACT

An organic light-emitting diode display device includes a data line, a first and second gate lines crossing the data line, an emission line crossing the data line, an organic light-emitting diode device having an anode electrode and a cathode electrode, a high-level potential driving voltage source for supplying a high-level potential driving voltage to the anode electrode, a first switch element for connecting a cathode electrode of the organic light-emitting diode device to a first node, a second switch element for connecting the data line to a second node, a third switch element for connecting the second node to a ground voltage source, a driving element for adjusting a current flowing between the cathode electrode of the organic light-emitting diode device and the first node in accordance with a voltage of the first node, a first capacitor connected between the second gate line and the first node, and a second capacitor connected between the first node and the second node.

14 Claims, 11 Drawing Sheets

ORGANIC LIGHT-EMITTING DIODE DISPLAY DEVICE AND DRIVING METHOD THEREOF

This application claims the benefit of Korean Patent Application No. P06-0060543 filed in Korea on Jun. 30, 2006, which is hereby incorporated by reference in its entirety.

BACKGROUND OF THE INVENTION

1. Field of the Invention

Embodiments of the present invention relates to a display device, and more particularly to an organic light-emitting diode display device and a driving method thereof. Although embodiments of the invention are suitable for a wide scope of applications, they are particularly suitable for reducing a data line charging time and preventing a residual image problem to improve a display quality.

2. Description of the Related Art

Recently, various flat panel display devices have been developed to have less weight and a thinner profile as compared to a cathode ray tube. Such flat panel display devices include a liquid crystal display device (hereinafter, referred to as "LCD"), a field emission display device (hereinafter, referred to as "FED"), a plasma display panel (hereinafter, referred to as "PDP") and an electro-luminescence display device, etc. However, each of these flat panel devices has advantages and drawbacks.

The PDP has light weight, thin profile and wide screen display capability because its structure and manufacturing process are simple, but yet it has low light-emission efficiency and large power consumption. An active matrix LCD employing a thin film transistor (hereinafter, referred to as "TFT") as a switching device has the drawback in that it is difficult to manufacture as a wide screen display screen because a semiconductor manufacturing processes are used, but the active matrix display is in high demand since it is typically used for a display device of a notebook personal computer.

The EL device, a self-luminous device, is generally classified as either an inorganic EL device or an organic light-emitting diode device depending upon the material of a light-emitting layer. When compared with the LCD and the PDP, the EL device has the advantages of fast response speed, large light-emission efficiency, high brightness and a wide viewing angle.

FIG. 1 shows the structure of a related art organic light-emitting diode device. Referring to FIG. 1, the organic light-emitting diode device includes a transparent anode electrode, an organic compound layer and a cathode electrode formed sequentially on a glass substrate. The organic compound layer includes a hole injection layer HIL, a hole transport layer HTL, an emission layer EML, an electron transport layer ETL and an electron injection layer. If a driving voltage is applied across the anode electrode and the cathode electrode, then a hole within the hole injection layer and an electron within the electron injection layer move toward the emission layer, respectively, to excite the emission layer, so that the emission layer emits visible rays. The visible rays generated from the emission layers of multiple pixels display a picture or a motion picture.

The organic light-emitting diode device can either be a passive matrix type or an active matrix type, which uses a TFT as switching element. In the passive matrix type device, the anode electrode crossing the cathode electrode are used to select a light-emitting cell in accordance with a current applied to the electrodes. In the active matrix type, an active element, such as a TFT, is turned on to select a light-emitting cell and maintains light-emission of the light-emitting cell by using a voltage maintained in a storage capacitor.

FIG. 2 is a schematic view of an organic light-emitting diode display device of a related art active matrix type. FIG. 3 is an equivalent circuit diagram of one pixel shown in FIG. 2. As shown in FIG. 2 and FIG. 3, the related art organic light-emitting diode display device has an organic light-emitting diode display panel 16 including pixels 22 respectively arranged at each intersection of gate lines GL and data lines DL, a gate driving circuit 18 for driving the gate lines GL, a data driving circuit 20 for driving the data lines DL and a timing controller 24 for controlling the gate driving circuit 18 and the data driving circuit 20.

The timing controller 24 controls the data driving circuit 20 and the gate driving circuit 18. To this end, the timing controller 24 supplies a variety of control signals to the data driving circuit 20 and the gate driving circuit 18. Further, the timing controller 24 re-aligns data to supply it to the data driving circuit 20.

The gate driving circuit 18 sequentially supplies a gate signal to the gate lines GL in response to a control signal from the timing controller 24. Herein, the gate signal is supplied in such a manner to have a width of one horizontal time 1H. The data driving circuit 20 supplies a video signal to the data lines DL by a control of the timing controller 24. In this case, the data driving circuit 20 supplies a video signal of one horizontal line to the data lines DL during one horizontal time 1H which the gate signal is supplied.

The pixels 22 emit light corresponding to a video signal, that is, a current signal supplied to the data lines DL, to thereby display a picture corresponding to the video signal. To this end, each of the pixels 22 includes an organic light-emitting diode device driving circuit 30 for driving an organic light-emitting diode device OLED in accordance with a driving signal supplied from each of the data lines DL and the gate lines GL. More specifically, the organic light-emitting diode device OLED is connected between the organic light-emitting diode device driving circuit 30 and a ground voltage source GND. The organic light-emitting diode device driving circuit 30 includes a first driving thin film transistor (hereinafter, referred to as "TFT") T1 connected between a high-level potential driving voltage source VDD and the organic light-emitting diode device OLED, a first switching TFT T3 connected between the gate line GL and the data line DL, a second driving TFT T2 connected between the first switching TFT T3 and the high-level potential driving voltage source VDD to provide the first driving TFT T1 and a current mirror circuit, a second switching TFT T4 connected between the gate line GL and the second driving TFT T2, and a storage capacitor Cst connected between a node positioned between the first and second driving TFT T1 and T2 and the high-level potential driving voltage source VDD. Herein, the TFTs are a p-type Metal-Oxide Semiconductor Field Effect Transistor (hereinafter, referred to as "MOSFET").

The gate element of the first driving TFT T1 is connected to the gate element of the second driving TFT T2, and a source element is connected to the high-level potential driving voltage source VDD. A drain element of the first driving TFT T1 is connected to the organic light-emitting diode device OLED. A source element of the second driving TFT T2 is connected to the high-level potential driving voltage source VDD, and a drain element is connected to a drain element of the first switching TFT T3 and a source element of the second switching TFT T4. A source element of the first switching TFT T3 is connected to the data line DL, and a gate element is connected to the gate line GL. A drain element of the second switching TFT T4 is connected to the gate elements of the first and second driving TFT T1 and T2 and the storage capacitor Cst. A gate element of the second switching TFT T4 is connected to the gate line GL. The first and second driving TFT T1 and T2 are connected in such a manner as to provide a current mirror. Accordingly, if the first and second driving TFT T1 and T2 have the same channel width, then the currents flowing in the first and second driving TFT T1 and T2 are equal.

An operation process of the organic light-emitting diode device driving circuit 30 will be described as follows. First, a gate signal is supplied from the gate line GL, which is a horizontal line. If the gate signal is supplied, then the first and second switching TFT T3 and T4 are turned-on. If the first and second switching TFT T3 and T4 are turned-on, then a video signal applied from the data line DL is supplied, via the first and second switching TFT T3 and T4, to the gate element of the first and second driving TFT T1 and T2. In this case, the first and second driving TFT T1 and T2 supplied with the video signal are turned-on.

The first driving TFT T1 adjusts a current flowing from the source element, that is, VDD of the first driving TFT T1 into the drain element in accordance with a video signal supplied to the gate element of the first driving TFT T1 to provide it to the organic light-emitting diode device OLED, so that the first driving TFT T1 controls light brightness of the organic light-emitting diode OLED corresponding to the video signal. Simultaneously, the second driving TFT T2 supplies, via the first switching TFT T3, a current Id supplied from the high-level potential driving voltage source VDD to the data line DL. Since the first and second driving TFT T1 and T2 form a current mirror circuit, then the same currents Id flow in the first and second driving TFT T1 and T2. Meanwhile, the storage capacitor Cst stores a voltage from the high-level potential driving voltage source VDD in such a manner as to correspond to the current Id flowing in the second driving TFT T2. Then, the storage capacitor Cst is turned-on by the first driving TFT T1 in response to the voltage stored in the storage capacitor Cst when the gate signal is off to be turned-off the first and second switching TFT T3 and T4, so that the storage capacitor Cst allows a current corresponding to the video signal to be supplied to the organic light-emitting diode device OLED.

A charging characteristics on the data line deteriorates due to the effect of a parasitic capacitance with the data line while driving at a low-level. When the related art organic light-emitting diode display device driven in accordance with a current drive method is driven at a low current level, then the problem of increased charging time occurs. To solve this problem, the related art organic light-emitting diode display device is implemented in such a manner as to be capable of scaling current by a proportional constant of T2/T1 on the condition that a function f1 for converting a data current Id into a data voltage Vp is linearly proportional to a function f2 for converting the data voltage Vp into the organic light-emitting diode device OLED current Ie1 in the organic light-emitting diode device driving circuit 30. But a proportional relationship between T2 and T1 is not always constantly maintained, and a difference between the pixels is generated by non-uniformities among the TFTs or a TFT deterioration. Accordingly, the related art organic light-emitting diode display device has a drawback of picture quality detioration. Because the related art organic light-emitting diode display device up-scales a current level in a constant ratio irregardless of a gray scale, there is also a problem in that a current for charging a data line is not enough in the case of a lower gray scale to be up-scaled in a relatively high ratio, and a bias stress of the driving TFT is increased for the case of a higher gray scale to be up-scaled in a relatively low ratio.

SUMMARY OF THE INVENTION

Accordingly, embodiments of the invention is directed to an organic light-emitting diode display device and a driving method thereof that substantially obviates one or more of the problems due to limitations and disadvantages of the related art.

An object of embodiments of the invention is to provide an organic light-emitting diode display device and a driving method thereof for reducing a data line charging time and improve picture quality uniformity.

Another object of embodiments of the invention is to provide an organic light-emitting diode display device and a driving method thereof for preventing a residual image problem and improve a display quality.

Another object of embodiments of the invention is to provide an organic light-emitting diode display device and a driving method thereof for increasing data charging time upon driving of a low-level gray scale and reducing bias stress burden for the driving TFT upon driving of a high-level gray scale.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

In order to achieve these and other objects of the invention, An organic light-emitting diode display device includes a data line, a first and second gate lines crossing the data line, an emission line crossing the data line, an organic light-emitting diode device having an anode electrode and a cathode electrode, a high-level potential driving voltage source for supplying a high-level potential driving voltage to the anode electrode, a first switch element for connecting a cathode electrode of the organic light-emitting diode device to a first node, a second switch element for connecting the data line to a second node, a third switch element for connecting the second node to a ground voltage source, a driving element for adjusting a current flowing between the cathode electrode of the organic light-emitting diode device and the first node in accordance with a voltage of the first node, a first capacitor connected between the second gate line and the first node, and a second capacitor connected between the first node and the second node.

In another aspect, a method of driving an organic light-emitting diode display device having a data line, first and second gate lines crossing the data line, an emission line crossing the data line, an organic light-emitting diode device having an anode electrode and a cathode electrode, a first switch element, a second switch element, a third switch element, a driving element, a first capacitor and a second capacitor includes: supplying a high-level potential driving voltage to the anode electrode from a high-level potential driving voltage source; connecting a cathode electrode of the organic light-emitting diode device to a first node through the a first switch element in response to a first scanning pulse from the first gate line; connecting the data line to a second node through the second switch element in response to a second scanning pulse from the second gate line; connecting the second node to a ground voltage source through the third switch element in response to an emission pulse from the emission line; adjusting a current flowing between the cathode electrode of the organic light-emitting diode device and the first node through the driving element in accordance with a voltage on the first node; and emitting light from the organic light-emitting diode device.

In another aspect, a method of driving an organic light-emitting diode device in which the organic light-emitting diode device together with a driving element are connected between a high-level driving voltage and a ground voltage source, and the driving element has a source electrode connected to a first node and a gate electrode connected to a second node, the method includes: during a first period, turning-on a first switch in response to a voltage of a first gate line to form a current path between a cathode electrode of the organic light-emitting diode device and the second node, turning-on a second switch in response to a voltage of a second gate line to form a current path between a data line and the first node, turning-off a third switch element in response to a voltage of a emission line to cut off a current path between the driving element and the ground voltage source, and supplying a pre-charge voltage to the data line, the pre-charge voltage is defined by a difference voltage between the high-level potential driving voltage and the threshold voltage of the organic light-emitting diode device; during a second period, maintaining on-state of the first and second switches, maintaining an off-state of the third switch, and supplying a predetermined up-scaling current higher than a data current corresponding to a video data to the data line; during a third period, turning-off the first and second switches and maintaining an off-state of the third switch to generate a division voltage of a capacitor connected to the first and second nodes and a capacitor connected between the second gate line and the second node, and down-scaling the up-scaling current into a magnitude of the current corresponding to the video data using the division voltage of the capacitors; and during a fourth period, maintaining an off-state of the first and second switches and turning-on the third switch to light-emitting the organic light-emitting diode device by the down-scaled current.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention, in which.

DETAILED DESCRIPTION OF THE PREFERRED EMBODIMENTS

Figure 1:
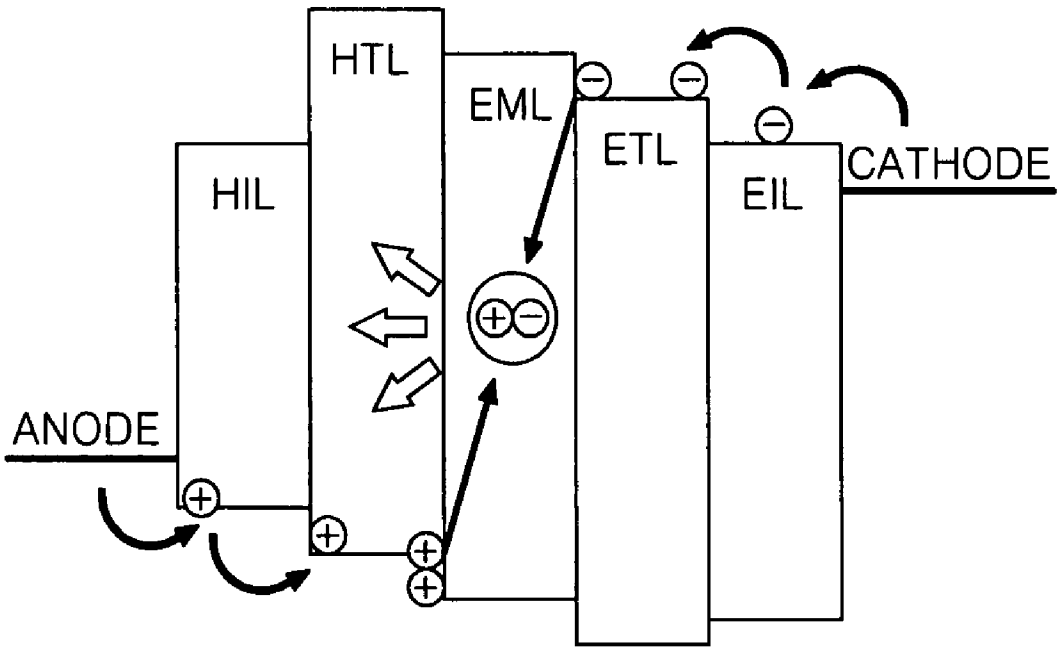
FIG. 1 RELATED ART
FIG. 1 shows the structure of a related art organic light-emitting diode device.
Figure 2:
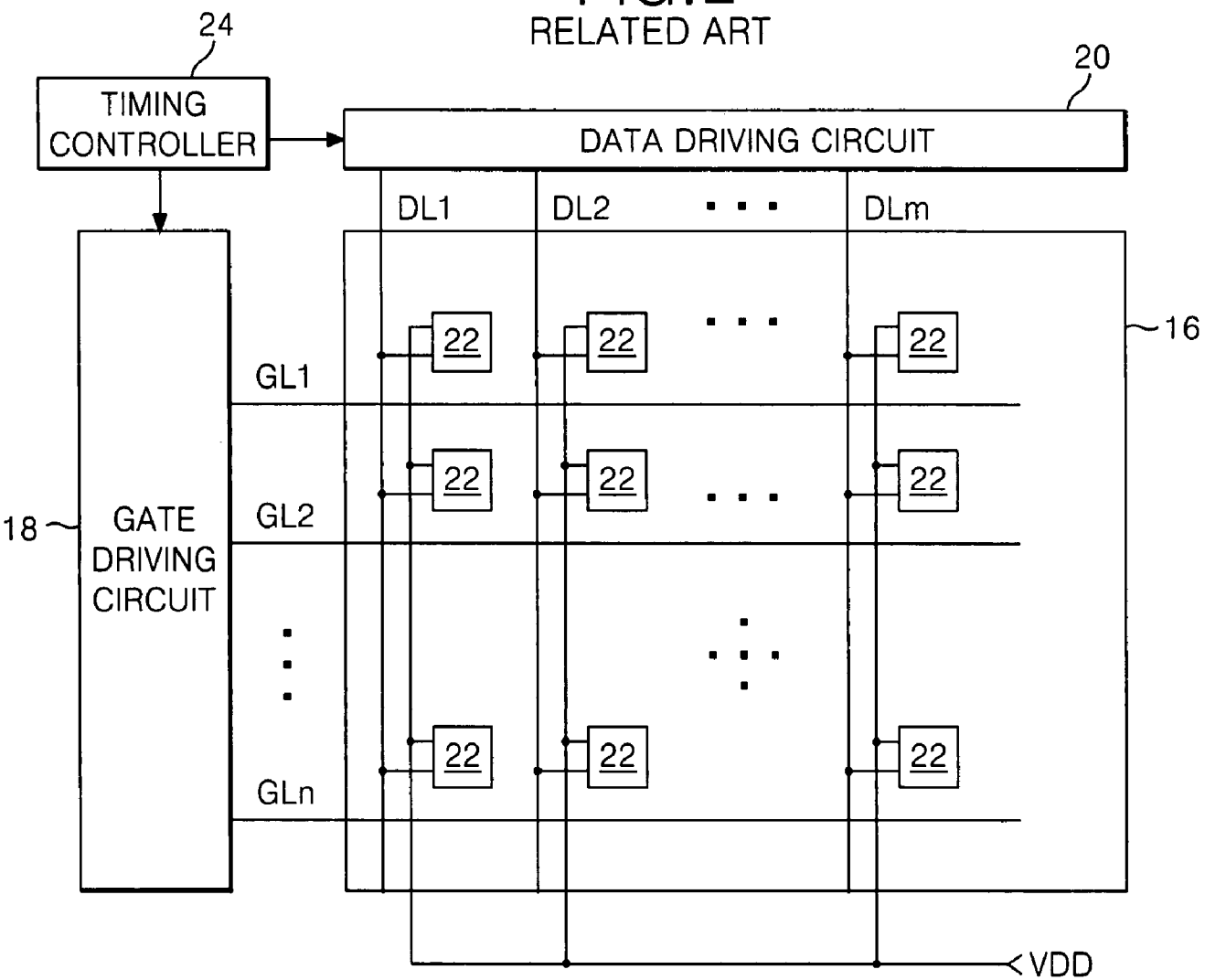
FIG. 2 RELATED ART
FIG. 2 is a schematic view of an organic light-emitting diode display device of a related art active matrix type.
Figure 3:
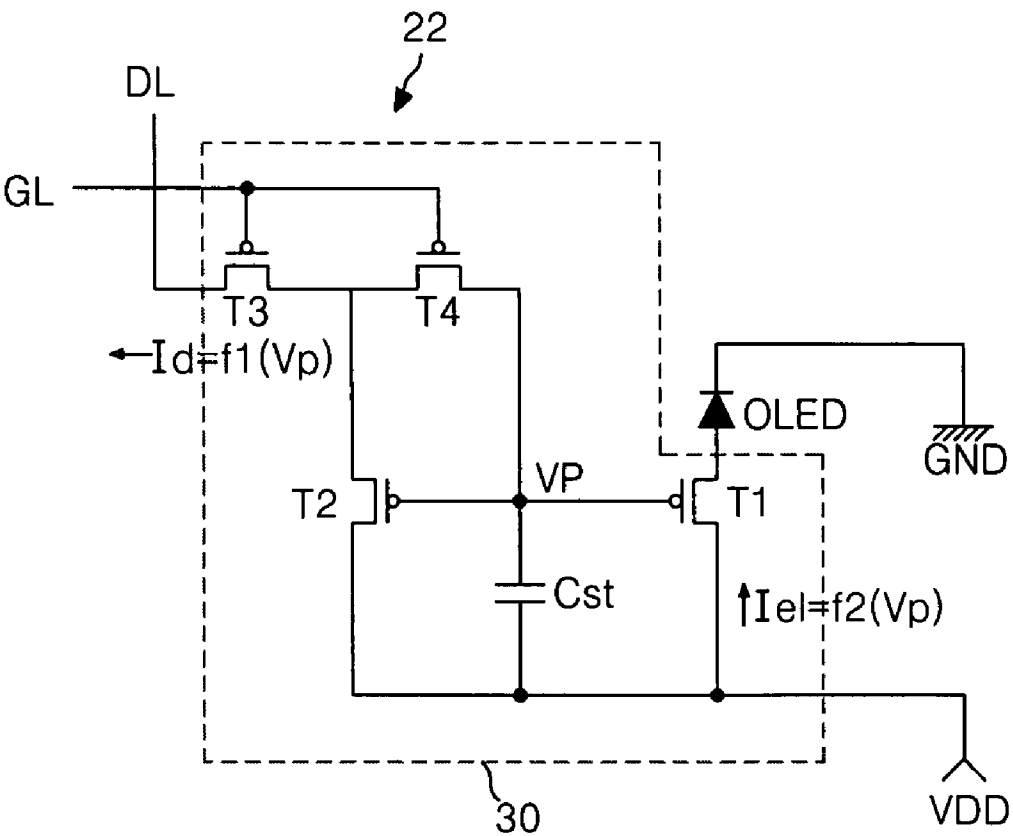
FIG. 3 RELATED ART
FIG. 3 is an equivalent circuit diagram of one pixel shown in FIG. 2.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements.

Figure 4:
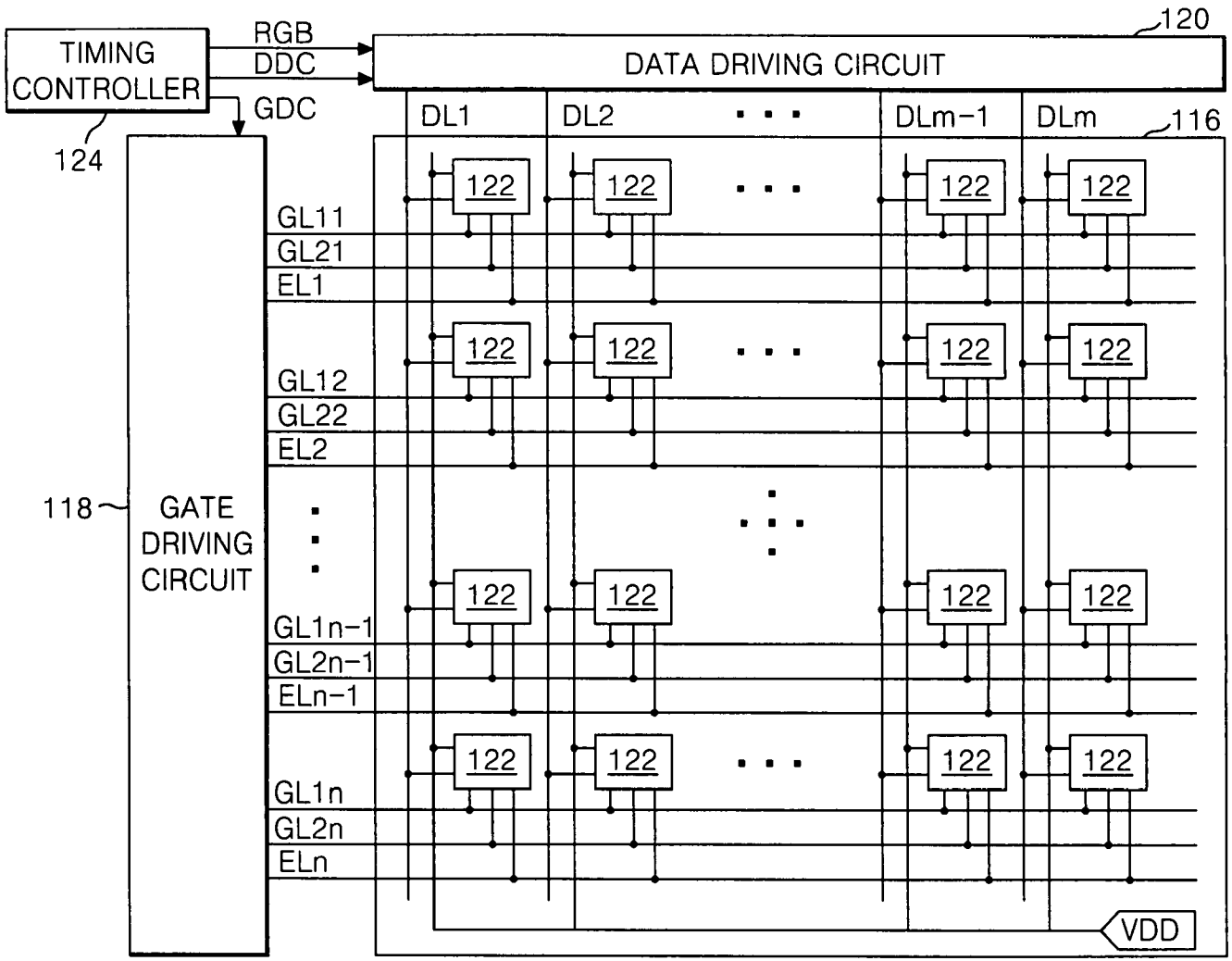
FIG. 4 is a block diagram of an organic light-emitting diode display device according to an embodiment of the invention.
Figure 5:
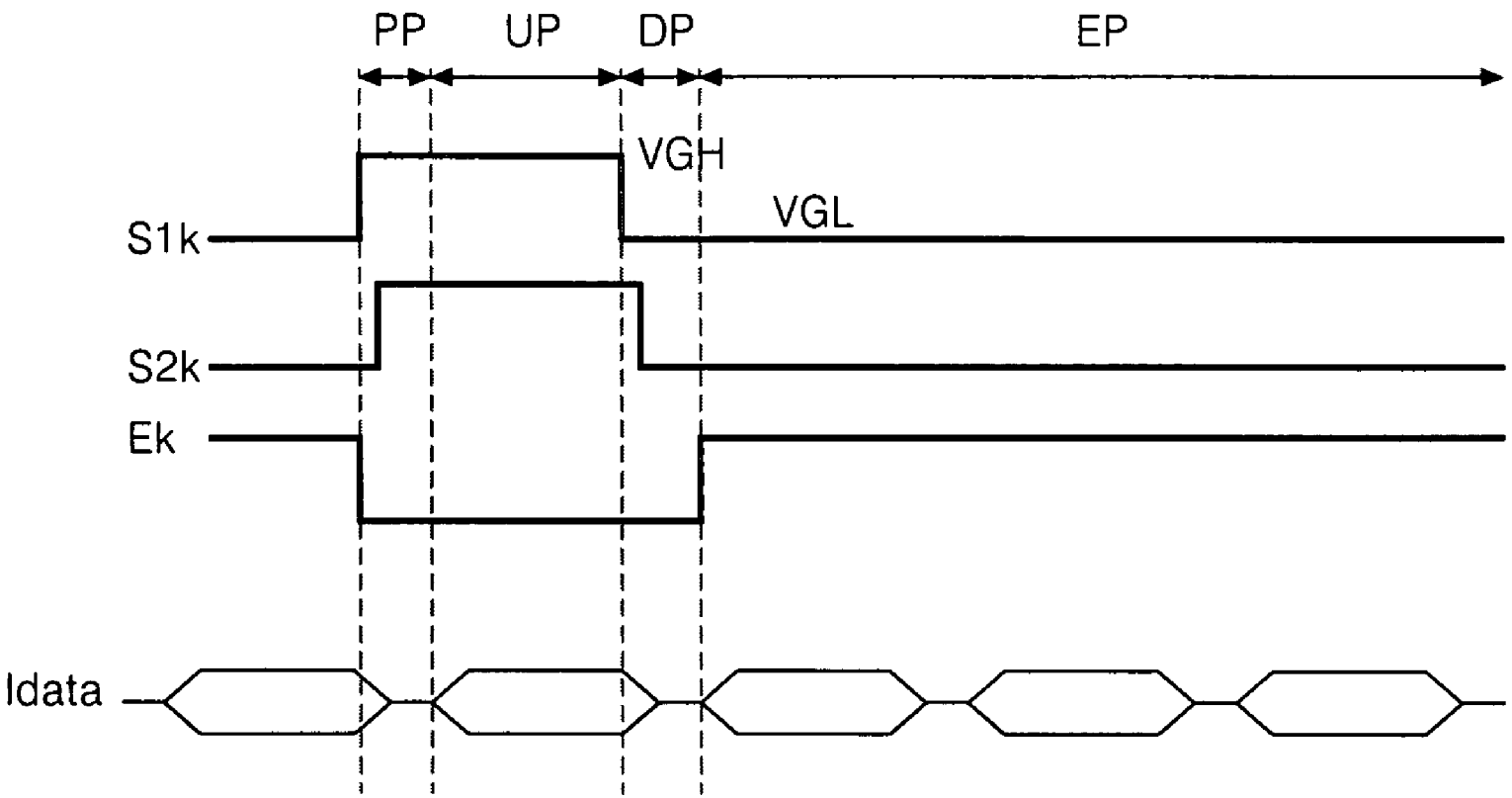
FIG. 5 is a diagram showing signal pulses applied to k (k is a positive integer having a value of more than 1 and less than n)th pixels in a vertical direction of FIG. 4 and a data current.

FIG. 4 is a block diagram showing an organic light-emitting diode display device according to an embodiment of the invention, and FIG. 5 is a diagram showing signal pulses applied to k (k is a positive integer having a value of more than 1 and less than n)th pixels in a vertical direction of FIG. 4 and a data current. Referring to FIG. 4 and FIG. 5, an organic light-emitting diode display device according to an embodiment of the invention includes a display panel 116 with m×n pixels 122, a data driving circuit 120 for supplying a pre-charge voltage and an up-scaling current to data lines DL1 to DLm, a timing controller 124 for controlling the driving circuits 118, and 120*a* gate driving circuit 118 for sequentially supplying three scanning pulse pairs to a first set of gate lines GL11 to GL1*n*, a second set of gate lines GL21 to GL2*n*, emission lines EL1 to ELn that are parallel to the first and second sets of gate lines that cross the data lines DL1 to DLm.

The pixels 122 are defined by the first set of gate lines GL11 to GLn, the second set of gate lines GL21 to GL2*n*, and the emission lines EL1 to ELn crossing the m data lines DL1 to DLm on the display panel 116. Signal wirings for supplying the high-level potential driving voltage VDD to each of the pixels 122 are formed on the display panel 116. Also, signal wirings for supplying the ground voltage GND to each of the pixels 122 are formed on the display panel 116 (not shown).

As shown in FIG. 5, PP represents a pre-charge period, UP represents an up-scaling period, DP represents a down-scaling period and EP represents an emission period. The data driving circuit 120 converts a digital video data RGB from the timing controller 124 into an analog gamma compensation voltage. The data driving circuit 120 supplies the pre-charge voltage Vpc to the data lines DL1 to DLm in response to a control signal DDC from the timing controller 124 during the pre-charge period PP. The data driving circuit 120 supplies an up-scaling current Idata, which is a larger current than a current to be applied corresponding to the converted analog gamma compensation voltage of the data lines DL1 to DLm in response to a control signal DDC from the timing controller 124 during the up-scaling period UP. The pre-charge and up-scaling periods are periods prior to the organic light-emitting diode of each pixel 122 emitting light.

The gate driving circuit 118 sequentially supplies a first scanning pulse S11 to S1*n*, like shown in FIG. 5, in response to a control signal GDC from the timing controller 124 to the first set of gate lines GL11 to GL1*n*, and sequentially supplies a second scanning pulse S21 to S2*n* to the second set of gate lines GL21 to GL2*n*. Also, the gate driving circuit 118 sequentially supplies an emission pulse E1 to En, like shown in FIG. 5, in response to a control signal GDC from the timing controller 124 to the emission lines EL1 to ELn. Further, the timing controller 124 supplies a digital video data RGB to the data driving circuit 120 and generates a control signal DDC and GDC for controlling an operation timing of the gate driving circuit 118 and the data driving circuit 120 using a vertical/horizontal synchronizing signal and a clock signal. A constant voltage source for supplying the high-level potential driving voltage VDD and a constant voltage source for supplying the ground voltage GND are connected to the display panel 116.

Figure 6:
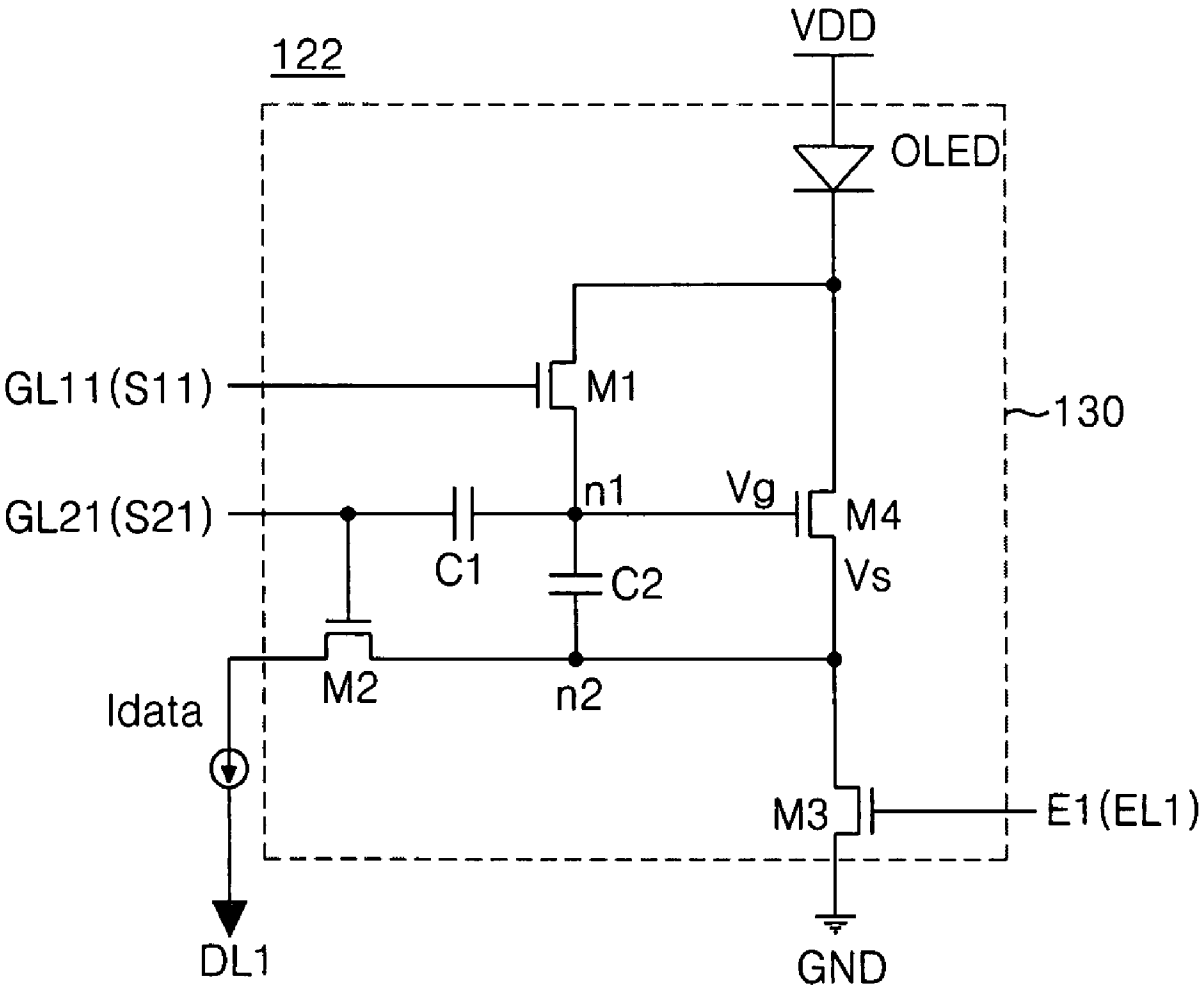
FIG. 6 is a circuit diagram showing pixels of the organic light-emitting diode display device according to an embodiment of the invention.

FIG. 6 is a circuit diagram showing pixels of the organic light-emitting diode display device according to an embodiment of the invention. Each of the pixels 122 includes the organic light-emitting diode device OLED, four TFTs and two capacitors, as shown in FIG. 6. An organic light-emitting diode device driving circuit 130 drives the organic light-emitting diode device OLED in accordance with a drive signal supplied to the data line DL1 to DLm and the signal lines GL1 to GL1*n*, GL21 to GL2*n* and EL1 to EL1. The organic light-emitting diode device OLED is connected between the organic light-emitting diode device driving circuit 130 and the high-level potential driving voltage source VDD.

An explanation of the structure of a single pixel 122 formed where the first data line DL1 and the signal lines GL1, GL21 and EL1 will be given below. The organic light-emitting diode device driving circuit 130 includes a first TFT M1 for connecting the first node n1 to a cathode electrode of the organic light-emitting diode device OLED in response to a first scanning pulse S11 from the first gate line GL11, a second TFT M2 for connecting the second node n2 to the data line DL1 in response to a second scanning pulse S21 from the second gate line GL21, a third TFT M3 for connecting the second node n2 to the ground voltage source GND in response to an emission pulse E1 from the emission line EL1, a fourth TFT M4 for adjusting a current flowing between a cathode electrode of the organic light-emitting diode device OLED and the first node n1 in accordance with a voltage of the first node n1, a first capacitor C1 connected between the second gate line GL21 and the first node n1, and a second capacitor C2 connected between the first node n1 and the second node n2. Herein, the TFTs are n-type electron Metal-Oxide Semiconductor Field Effect Transistor (MOSFET).

The first TFT M1 is turned-on by the first scanning pulse S11 supplied from the first gate line GL11 to provide a current path between a cathode electrode of the organic light-emitting diode device OLED and the first node n1 during the pre-charge time PP and the up-scaling period UP while the first TFT M1 is turned-off by the first scanning pulse S11 supplied from the first gate line GL11 to block a current path between a cathode electrode of the organic light-emitting diode device OLED and the first node n1 during the down-scaling period DP and the light-emitting period EP. A gate electrode of the first TFT M1 is connected to the first gate line GL11, a source electrode of the first TFT M1 is connected to the first node n1. A drain electrode of the first TFT M1 is connected to a cathode electrode of the organic light-emitting diode device OLED.

The second TFT M2 is turned-on by the second scanning pulse S21 supplied from the second gate line GL21 to provide a current path between the data line DL1 and the second node n2 during the pre-charge time PP and the up-scaling period UP while the first TFT M1 is turned-off by the first scanning pulse S11 supplied from the first gate line GL11 to block a current path between the data line DL1 and the second node n2 during the down-scaling period DP and the light-emitting period EP. The second scanning pulse S21 has the same duty ratio as the first scanning pulse and is generated in such a manner as to have a constant phase difference with the first scanning pulse late. A gate electrode of the second TFT M2 is connected to the second gate line GL21, a source electrode of the second TFT M2 is connected to the data line DL1. A drain electrode of the second TFT M2 is connected to the second node n2.

The third TFT M3 is turned-off by the emission pulse E1 supplied from the emission line EL1 to block a current path between the second node n2 and the ground voltage source GND during the pre-charge time PP, the up-scaling period UP and the down-scaling period DP while the third TFT M3 is turned-on by the emission pulse E1 supplied from the emission line EL1 to provide a current path between the second node and the ground voltage source GND during the light-emitting period EP. A gate electrode of the third TFT M3 is connected to the emission line EL1, a source electrode of the third TFT M3 is connected to the ground voltage source GND. A drain electrode of the third TFT M3 is connected to the second node n2.

The fourth TFT M4 is a driving TFT that adjusts a current flowing between a cathode electrode of the organic light-emitting diode device OLED and the second node n2 in accordance with a voltage of the first node n1. A gate electrode of the fourth TFT M4 is connected to the first node n1, a source electrode of the fourth TFT M4 is connected to the second node n2. A drain electrode of the fourth TFT M4 is connected to a cathode electrode of the organic light-emitting diode device OLED.

The first capacitor. C1 reduces a gate voltage of the fourth TFT M4 to allow a current flowing into the organic light-emitting diode device OLED to be reduced during the down-scaling period DP. The first capacitor C1 is connected between the second gate line GL21 and the first node n1. The second capacitor C2 is a storage capacitor Cst that maintains a gate voltage of the fourth TFT M4 to allow a current flowing into the organic light-emitting diode device OLED to be constantly maintained during the light-emitting period EP. The second capacitor C2 is connected between the first node n1 and the second node n2. The organic light-emitting diode device OLED emits light due to a current $I_{OLED}$ flowing via the third TFT M3 and the fourth TFT M4, as shown by the dotted line in FIG. 11, during the light-emitting period EP.

Figure 7:
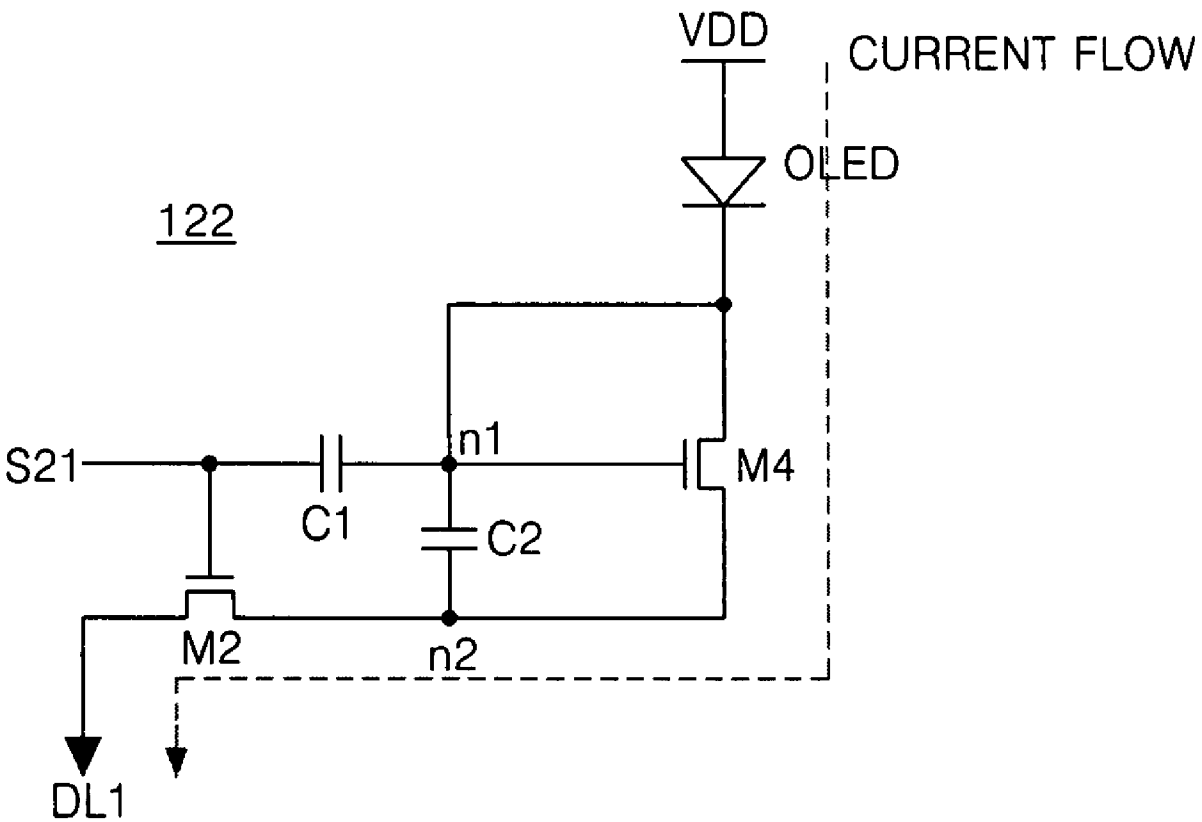
FIG. 7 is an equivalent circuit diagram of a pixel during a pre-charge time PP.
Figure 8:
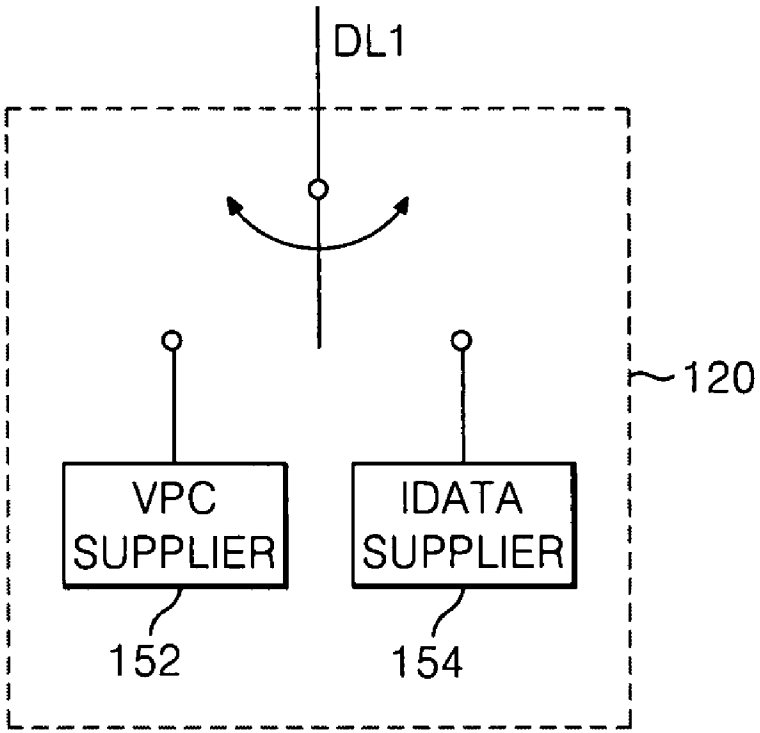
FIG. 8 is a diagram showing a Vpc supply measure and an Idata supply measure within a data driving circuit.

Operation of the pixels 122 will be described with reference to FIG. 7 to FIG. 11. FIG. 7 is an equivalent circuit diagram of a pixel during a pre-charge time PP, and FIG. 8 is a diagram showing a Vpc supply measure and an Idata supply measure within a data driving circuit. Referring to FIG. 7 and FIG. 8, the first scanning pulse S11 maintains a high-level logic voltage to turn on the first TFT M1, the second scanning pulse S21 generated after the first scanning pulse S11 is a high-level logic voltage that turns on the second TFT M2, and the emission pulse E1 is a low-level logic voltage that turns off the third TFT M3 during the pre-charge period PP. Accordingly, a cathode electrode of the organic light-emitting diode device OLED and the first node n1 are electrically shorted, and a current path between the second node n2 and the ground voltage source GND is blocked. During this state, a pre-charge voltage Vpc is supplied to the data line DL1. The pre-charge voltage Vpc is defined by a difference voltage between the high-level potential driving voltage VDD and the threshold voltage of the organic light-emitting diode device OLED. is supplied to the data line DL1. A pre-charge voltage Vpc supplied to the data line DL1 is stored at the second capacitor C2 connected between the first node n1 and the second node n2. Such a pre-charge voltage Vpc is a high-level voltage similar to the high-level potential driving voltage VDD and plays a role in reducing charging time of the data line DL1 at a low-level gray scale. The data driving circuit 120 connects a Vpc supplier 152 to the data line DL1 in response to a control signal DDC of the timing controller 124 to allow a pre-charge voltage Vpc to be supplied to the data line DL1, as shown in FIG. 8.

Figure 9:
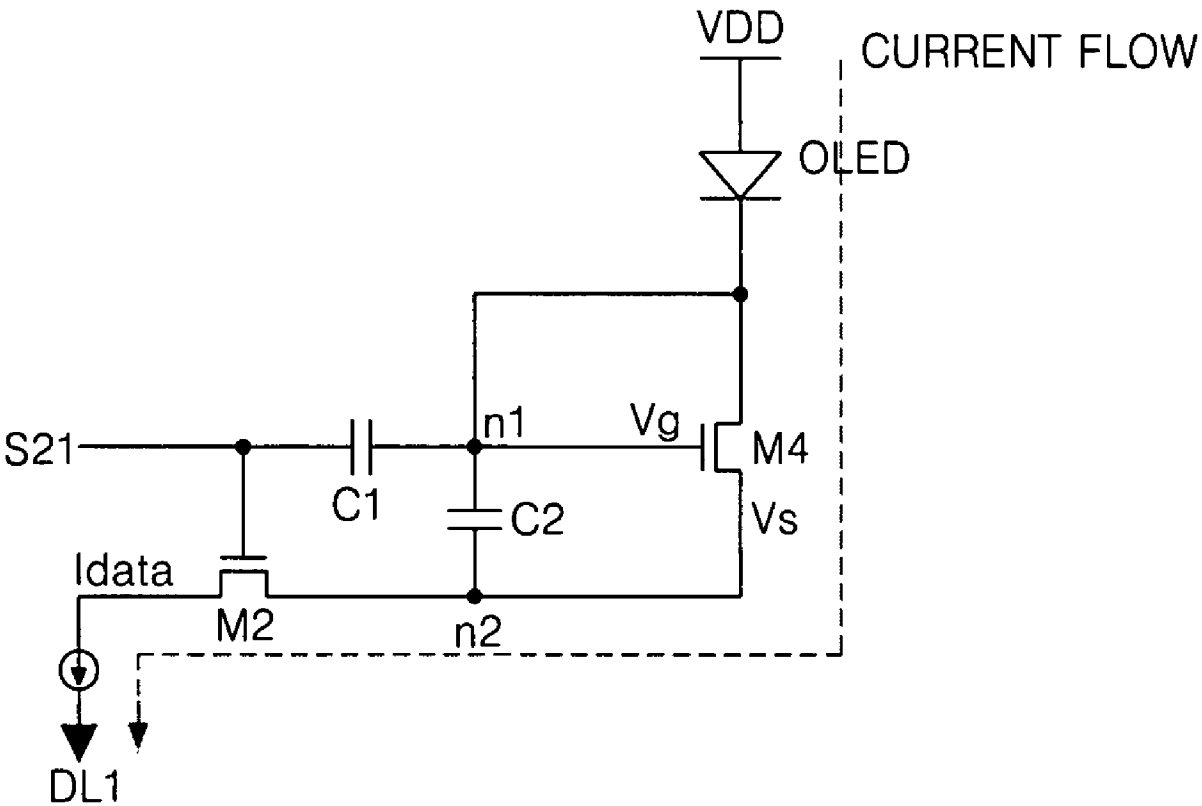
FIG. 9 is an equivalent circuit diagram of the pixel 122 during an up-scaling period UP.

FIG. 9 is an equivalent circuit diagram of the pixel 122 during an up-scaling period UP. Referring to FIG. 9, the first scanning pulse S11 and the second scanning pulse S21 provide a high-level logic voltages to the first TFT M1 and the second TFT M2 so as to turn them on, and the emission pulse E1 is at a low-level logic voltage so as to turn off the third TFT M3 during the up-scaling period UP. Accordingly, a cathode electrode of the organic light-emitting diode device OLED and the first node n1 are electrically shorted while a current path between the second node n2 and the ground voltage source GND is blocked. Also, a pre-charge voltage Vpc is charged onto the second capacitor C2, so that the potential of the first node n1 is maintained as Vpc. During this state, the data line DL1 is supplied with the up-scaling current $I_{data}$ defined by first item (1) of Equation 1, as follows.

[Equation 1]

$$I_{data} = I_{OLED} = K_{DR}(Vgs - Vth)^2 \quad (1)$$

$$Vgs = \sqrt{\frac{I_{data}}{K_{DR}}} + Vth \quad (2)$$

$I_{OLED}$ represents a current of the organic light-emitting diode device OLED, Vgs is a voltage applied between the gate electrode and the source electrode of the fourth TFT M4, Vth is a threshold voltage of the fourth TFT M4 and $k_{DR}$ is a constant defined by the mobility and the parasitic capacitance of the fourth TFT M4.

A cathode electrode of the organic light-emitting diode device OLED and the first node n1 are electrically shorted so that a gate and a drain of the fourth TFT M4 have the same potential as a cathode electrode of the organic light-emitting diode device OLED. During this state, if the up-scaling current $I_{data}$ is applied, then the fourth TFT M4 is operated in saturation and a current equation is defined by Vgs, so that a relational expression like equation 1 is formed. Such an up-scaling current $I_{data}$ is generated that is larger than an integer multiple of a current $I_{OLED}$ flowing into the organic light-emitting diode device OLED during the light-emitting period EP. Specifically, the up-scaling current $I_{data}$ is generated in such a manner as to have a higher multiple at a low-level gray scale when the gray scale of a digital video data is at a low-level gray scale range and a relatively lower multiple at a high-level gray scale when the gray scale of a digital video data is at a high-level gray scale range. The low-level gray scale is less than a predetermined reference gray scale, and the high-level gray scale is equal or larger than the predetermined reference gray scale. The reference gray scale can be set at a different value depending upon the characteristics of the OLED panel. For example, the value of the reference gray scale can be set at about 40% of a peak white gray scale value. The up-scaling current $I_{data}$ supplied to the data line DL1 is higher than a data current to be applied to the data line DL1. Thus, the Vgs is set in accordance with the equation 1-(2) for temporary storage in the second capacitor C2. As a result, the up-scaling current $I_{data}$ alleviates an effect of the parasitic capacitance existing in the data line DL1 to reduce a charging time of the data line DL1.

Referring to FIG. 8, the data driving circuit 120 connects Idata supplier 154 to the data line DL1 in response to the control signal DDC of the timing controller 124 to allow the up-scaling current $I_{data}$ to be supplied to the data line DL1. The Idata supplier 154 generates an up-scaling current $I_{data}$ having a different magnitude in accordance with a gray scale range. In the related art, if a data current 100 nA having an integer ratio (for example, five times) than a current (for example, 20 nA) is applied to the related art organic light-emitting diode device OLED to reduce a charging time of the data line upon driving at a low-level gray scale and a data current of 5 μA having the same integer ratio (five times) than a current (for example, 1 μA) to is applied at a high-level gray scale. Since the data current is linearly up-scaled in the same proportion from a low-level gray scale to a high-level gray scale, there are problems in that the current for sufficiently charging an data line is not enough at the low-level gray scale while up-scaling at the high-level gray scale with a relatively high ratio puts a high bias stress on the driving TFT.

The up-scaling ratio at a high-level gray scale should be a relatively lower ratio. As described above, embodiments of the invention supply a data current 1 μA having higher integer ratio (for example, fifty times) at low-level gray scale to be up-scaled in a relatively high ratio while suppling a data current 2 μA having a lower integer ratio (for example, two times) at the high-level gray scale. Thus, embodiments of the invention can reduce data charging time when driving at the low-level gray scale, and alleviate a bias stress burden of the driving TFT when driving of a high-level gray scale.

Figure 10:
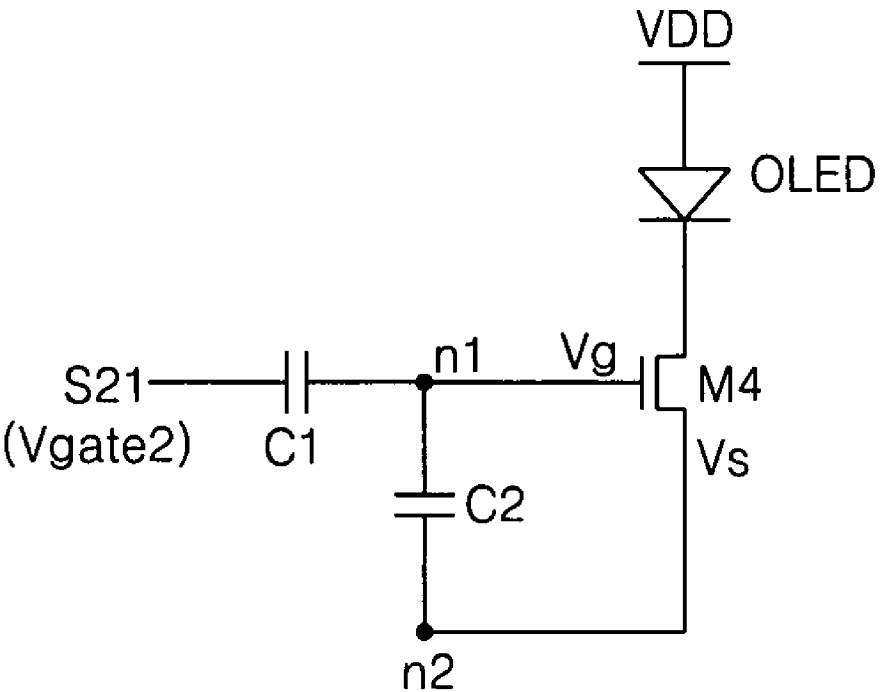
FIG. 10 is an equivalent circuit diagram of the pixel 122 during a down-scaling period DP.

FIG. 10 is an equivalent circuit diagram of the pixel 122 during a down-scaling period DP. Referring to FIG. 10, the first scanning pulse S11 is a low-level logic voltage to turn off the first TFT M1, and the emission pulse E1 is a low-level logic voltage to maintain the third TFT M3 in a turn-off state during the down-scaling period DP. Accordingly, an electric connection occurs between a cathode electrode of the organic light-emitting diode device OLED and the first node n1 while a current path between the second node n2 and the ground voltage source GND is blocked state. The second scanning pulse S21 is a low-level logic voltage generated after the first scanning pulse S11 is generated to turn-off the second TFT M2. Accordingly, if the second scanning pulse S21 is changed from a high-level logic voltage VGH into a low-level logic voltage VGL, then a voltage of the second capacitor C2, that is, Vgs is decreased as ΔVgs like a first item (1) of equation 2 by a capacitive-coupling phenomenon of the first and second capacitors C1 and C2. Further, Vgs voltage of the fourth TFT M4 is decreased as ΔVgs, so that a current $I_{OLED}$ of the organic light-emitting diode device OLED is non-linearly down-scaled to thereby satisfy a third item (3) of equation 1. A second item (2) of equation 2 defines an up-scaling current.

[Equation 2]

$$\Delta Vgs = \frac{C1}{C1 + C2}(\Delta Vgate2 - \Delta Vs) \quad (1)$$

$$I_{data} = k_{DR}(Vgs - Vth)^2 \quad (2)$$

$$I_{OLED} = k_{DR}(Vgs - \Delta Vgs - Vth)^2 \quad (3)$$

$I_{OLED}$ represents a current of the organic light-emitting diode device OLED, $k_{DR}$ is a constant defined by mobility and a parasitic capacitance of the fourth TFT M4, Vgs is a voltage applied between the gate electrode and the source electrode of the fourth TFT M4, ΔVgs is a variation of Vgs, Vth is a threshold voltage of the fourth TFT M4, Idata is an up-scaling current, C1 is a capacitance of the first capacitor, C2 is a capacitance of the second capacitor, ΔVgate2 is a variation of a logic voltage of the second scanning pulse S21 and ΔVs is a variation of a source voltage of the fourth TFT M4.

Referring to equation 1 and equation 2, a pixel circuit is non-linearly down-scaled in accordance with a gray scale. In other words, ΔVgs has a constant value by a first item (1) of equation 2 and IOLED is in proportion to $(Vgs-\Delta Vgs-Vth)^2$ by a third item (3) of equation 2, so that the pixel circuit is non-linearly down-scaled depending on gray scale range.

Figure 11:
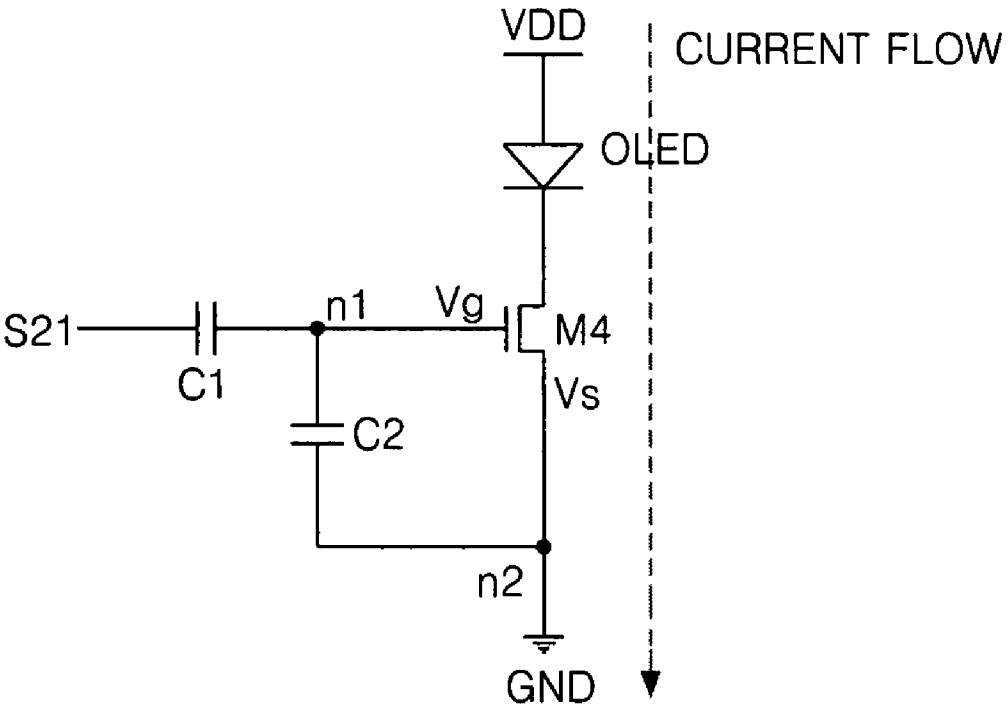
FIG. 11 is an equivalent circuit diagram of the pixel 122 during a light-emitting period EP.

FIG. 11 is an equivalent circuit diagram of the pixel 122 during a light-emitting period EP. Referring to FIG. 11, the first scanning pulse S11 and the second scanning pulse S21 are low-level logic voltages to maintain the first TFT M1 and the second TFT M2 in a turn-off state, and the emission pulse E1 is a high-level logic voltage to turn-on the third TFT M3 during the light-emitting period DP. Accordingly, a current path between the second node n2 and the ground voltage source GND is formed, so that the down-scaled current $I_{OLED}$ like a third item (3) of equation 2 flows via the organic light-emitting diode device OLED.

As described above, the organic light-emitting diode display device and the driving method thereof according to embodiments of the invention supplies a pre-charge voltage to charge the data line and charges the data line by using higher up-scaling current than a current to be applied corresponding to gray scale range of the video data, and then again down-scales a current upon light-emitting to thereby reduce a data line charging time while also protecting a driving transistor to improve a display quality such as a picture quality uniformity improvement. Specifically, the organic light-emitting diode display device and the driving method thereof according to embodiments of the invention non-linearly charges the up-scaling current into the data line in accordance with a gray scale range and non-linearly down-scales a current to light-emit in accordance with a gray scale. As a result, the organic light-emitting diode display device and the driving method thereof can further reduce a data charging time upon driving at a low-level gray scale, and can alleviate a bias stress burden of the driving TFT upon driving at a high-level gray scale.

It will be apparent to those skilled in the art that various modifications and variations can be made in embodiments of the invention without departing from the spirit or scope of the invention. Thus, it is intended that embodiments of the invention cover the modifications and variations of this invention provided they come within the scope of the appended claims and their equivalents.

What is claimed is:

1. An organic light-emitting diode display device, comprising:

a data line;

first and second gate lines crossing the data line;

an emission line crossing the data line;

an organic light-emitting diode device having an anode electrode and a cathode electrode;

a high-level potential driving voltage source for supplying a high-level potential driving voltage to the anode electrode;

a first switch element for connecting a cathode electrode of the organic light-emitting diode device to a first node;

a second switch element for connecting the data line to a second node;

a third switch element for connecting the second node to a ground voltage source;

a driving element for adjusting a current flowing between the cathode electrode of the organic light-emitting diode device and the second node in accordance with a voltage of the first node;

a first capacitor connected between the second gate line and the first node; and a second capacitor connected between the first node and the second node, wherein the driving element includes a gate electrode connected to the first node, a source electrode connected to the second node, and a drain electrode connected to the cathode electrode of the organic light-emitting diode device.

2. The organic light-emitting diode display device as recited in claim 1, wherein the first switch element includes a gate electrode connected to the first gate line, a source electrode connected to the first node, and a drain electrode connected to the cathode electrode of the organic light-emitting diode device.

3. The organic light-emitting diode display device as recited in claim 1, wherein the second switch element includes a gate electrode connected to the second gate line, a source electrode connected to the data line, and a drain electrode connected to the second node.

4. The organic light-emitting diode display device as recited in claim 1, wherein the third switch element includes a gate electrode connected to the emission line, a source electrode connected to the ground voltage source, and a drain electrode connected to the second node.

5. A method of driving an organic light-emitting diode display device having a data line, first and second gate lines crossing the data line, an emission line crossing the data line, an organic light-emitting diode device having an anode electrode and a cathode electrode, a first switch element, a second switch element, a third switch element, a driving element, a first capacitor and a second capacitor, comprising:

supplying a high-level potential driving voltage to the anode electrode from a high-level potential driving voltage source;

connecting a cathode electrode of the organic light-emitting diode device to a first node through the first switch element in response to a first scanning pulse from the first gate line;

connecting the data line to a second node through the second switch element in response to a second scanning pulse from the second gate line;

connecting the second node to a ground voltage source through the third switch element in response to an emission pulse from the emission line;

adjusting a current flowing between the cathode electrode of the organic light-emitting diode device and the second node through the driving element in accordance with a voltage on the first node; and emitting light from the organic light-emitting diode device, wherein the first and second scanning pulses are at an active logic voltage during a first period, and the first and second scanning pulses are maintained at the active logic voltage during a second period.

6. The method of driving an organic light-emitting diode display device as recited in claim 5, wherein the emission pulse is maintained at a non-active logic voltage during the first and second periods.

7. The method of driving an organic light-emitting diode display device as recited in claim 5, further comprising:

supplying a pre-charge voltage to the data line during the first period, the pre-charge voltage is defined by a difference voltage between the high-level potential driving voltage and the threshold voltage of the organic light-emitting diode device such that the pre-charge voltage is charged onto the first node by turning-on the second switch element during the first period.

8. The method of driving an organic light-emitting diode display device as recited in claim 5, further comprising:

supplying an up-scaling current $I_{data}$ defined by the following equation to the data line during the second period such that the up-scaling current is charged onto the second node by turning-on the second switch element during the second period, $$I_{data} = I_{OLED} = K_{DR}(Vgs - Vth)^2$$

$$Vgs = \sqrt{\frac{I_{data}}{K_{DR}}} + Vth$$

$I_{OLED}$ represents a current of the organic light-emitting diode device, Vgs represents a voltage applied between the gate electrode and the source electrode of the driving element, Vth represents a threshold voltage of the driving element and $k_{DR}$ represent a constant defined by mobility and a parasitic capacitance of the driving element.

9. The method of driving an organic light-emitting diode display device as recited in claim 8, wherein the up-scaling current is generated as a current larger than an integer multiple of a current flowing into the organic light-emitting diode device; and the integer multiple in a lower gray scale of a digital video data is larger than that in a higher gray scale of a digital video data, the low gray scale is less than a predetermined reference gray scale and the high gray scale is equal or larger than the predetermined reference gray scale.

10. The method of driving an organic light-emitting diode display device as recited in claim 5, further comprising:

changing the first and second scanning pulses into a non-active logic voltage during a third period, and maintained the first and second scanning pulses in a non-active logic voltage during a fourth period.

11. The method of driving an organic light-emitting diode display device as recited in claim 10, wherein during the third period, the first and second switch elements are turned-off in response to the non-active voltages of the scanning pulses; and a voltage Vgs between the gate and the source of the driving element is changed as much as ΔVgs defined by the following equation, and a current $I_{OLED}$ flowing into the organic light-emitting diode device is changed by the following equation, $$\Delta Vgs = \frac{C1}{C1 + C2}(\Delta Vgate2 - \Delta Vs)$$

$$I_{OLED} = k_{DR}(Vgs - \Delta Vgs - Vth)^2$$

$k_{DR}$ represents a constant defined by mobility and a parasitic capacitance of the driving element, Vgs represents a voltage applied between the gate electrode and the source electrode of the driving element, ΔVgs represents a variation of Vgs, Vth represents a threshold voltage of the driving element, C1 is a capacitance of the first capacitor, C2 is a capacitance of the second capacitor, ΔVgate2 represents a variation of a logic voltage of the second scanning pulse S21, and ΔVs represents a variation of a source voltage of the driving element.

12. The method of driving an organic light-emitting diode display device as recited in claim 10, further comprising:

maintaining the emission pulse at a non-active logic voltage during the third period.

13. The method of driving an organic light-emitting diode display device as recited in claim 12, further comprising:

changing the emission pulse into an active voltage during the fourth period.

14. The method of driving an organic light-emitting diode display device as recited in claim 13, wherein the third switch element is turned-on in response to an active voltage of the emission pulse to electrically form a current path between the driving element and the ground voltage source during the fourth period.

* * * * *